United States Patent [19]

Dicke et al.

[11] Patent Number: 4,694,601

[45] Date of Patent: Sep. 22, 1987

[54] PORTABLE COLLAPSIBLE HIGHWAY SIGN

[75] Inventors: Grant D. Dicke, Downers Grove; Jeffrey A. Williams, Bolingbrook, both of Ill.

[73] Assignee: Dicke Tool Company, Downers Grove, Ill.

[21] Appl. No.: 799,302

[22] Filed: Nov. 18, 1985

[51] Int. Cl.[4] ..... G09F 10/00

[52] U.S. Cl. ..... 40/610; 40/606; 40/10 R; 160/377

[58] Field of Search ..... 160/377, 378; 40/610, 40/606, 607

[56] References Cited

U.S. PATENT DOCUMENTS

| | | | |
|---|---|---|---|
| 3,899,843 | 8/1975 | Doyle et al. | 40/603 |
| 4,490,934 | 1/1985 | Knapp | 40/610 |
| 4,592,158 | 6/1986 | Seely | 40/603 |

*Primary Examiner*—Gene Mancene
*Assistant Examiner*—Wenceslao J. Contreras
*Attorney, Agent, or Firm*—Keil & Weinkauf

[57] ABSTRACT

The invention provides a portable, collapsible sign comprised of a flexible, durable panel secured to a frame of four arms pivotally attached to a rigid central web so as to fold down one direction only and form a compact bundle for storage. The arms in the extended position are in the form of a cross and hold the sign panel firmly extended. The portable sign can be quickly assembled and disassembled.

11 Claims, 5 Drawing Figures

PORTABLE COLLAPSIBLE HIGHWAY SIGN

BACKGROUND OF THE INVENTION AND PRIOR ART

1. Field of the Invention

The invention relates to an improved durable, collapsible highway sign which permits deflection of strong wind forces without damage and can be readily assembled and quickly disassembled for compact storage. The improved sign is intended to be used with a base support such as disclosed as Ser. No. 594,879 for "Deflecting Mounting for Upright Mast", filed Mar. 29, 1984.

2. Prior Art

There is often a need along public highways and pedestrian walkways for signs to provide information and mark off limits. Frequently, the need is temporary and it is advantageous to have signs which may be readily assembled and disassembled; yet which are durable and resistant to weather elements, high winds, air currents generated by the movement of vehicles and rough handling. Also, it is advantageous that such signs be temporarily deflectible by a direct contact of vehicles and pedestrians and the like without permanent damage or being torn from its supports.

There have been a number of structures devised for rectangular highways signs which are subjected to deflection by wind forces and the like. U.S. Pat. No. 4,490,934 discloses a portable, collapsible, rectangular signal device, including a rectangular sign panel attached to a self-supporting frame in the form of a cross. A structure shown in U.S. Pat. No. 4,426,800 includes two elongated framed members in a cross-configuration which fit within corner brackets attached to the rectangular sign panel. An additional structure shown in U.S. Pat. No. 4,019,271 discloses a portable sign that can be easily erected and taken down and having a display portion with an erected mast and a cross arm that support the display portion. Also, in U.S. Pat. No. 3,899,843 there is shown a sign having rigid extension arms which yieldably urged into position for supporting the sign and will blend with a predetermined wind load on the sign.

The prior art structure often have involved cumbersome units that are difficult to set up and use in highway construction. Also, these prior structures usually do not provide for quick action attachments which allow for easy release of a collapsible sign panel for a fast breakdown when the job is completed so that they can be quickly folded down and take up little storage space. Often the prior art structures do not rely on sturdy rigid supports for the sign panel which minimize twist and deflection fo the sign panel. Frequently, the prior art structures do not rely on sturdy structures and durable sign panels to withstand rough handling and weather conditions over long periods of time. Finally, the prior art structures are not designed for quick and easy mounting with base mountings such as mast attached base mountings as disclosed in applicant's co-pending Ser. No. 594,874 for Deflectable Mounting for Upright Mast.

SUMMARY OF THE INVENTION

The present invention provides a collapsible sign which includes a panel formed of a durable, flexible member fastened to four pivotally mounted arms. The arms extend in the form of a cross from a central web and form a rigid support for the panel. The vertical arms are composed of rigid tubing which firmly supports the panel and minimizes twist and deflection thereof. The horizontal arms are composed of rigid tubing also to prevent the unit from twisting. Each arm is pivotally mounted through one of four channel sections attached to a rigid plate of the central web so as to fold in one direction. Each arm has a securing device which protrudes through a hole in the channel section to lock the arm in an extended position and maintain the panel firmly extended minimizing lateral movement relative to the axis of the vertical arms. The sign panel is fastened to each arm on the side and in the direction that it is foldable. One of the arms is mountable to a suitable mast central support or other telescopic support piece attached to a base when in use.

Accordingly, it is an object of the present invention to provide an improved portable, collapsible highway sign.

It is also an object of the present invention to provide means for pivotally mounting the support arms to a rigid central web and to maintain a flexible panel in a firmly extended condition minimizing twisting or swinging laterally with respect to a vertical arm.

It is another object of the present invention to provide an improved, collapsible, durable highway sign wherein means are provided for allowing the sign to be quickly and easily folded down to a compact storage bundle.

It is a further object of the present invention to provide an improved portable, collapsible, durable highway sign providing means for firmly fastening the panel member so as to prevent it from being torn from the frame members by a reversible wind and to facilitate spillage of the wind pass the sign.

It is another object of the present invention to provide an improved portable, collapsible highway sign providing means for easily mounting the sign to a suitable vertical mast support or other telescoping base and for easy dismounting therefrom.

BRIEF DESCRIPTION OF THE DRAWINGS

Many other objects and advantages of the present invention will become apparent from the following detailed description taken in conjunction with the drawings, in which.

DETAILED DESCRIPTION

The present invention and the objects therein will be more readily understood from the detailed description set forth below and the accompanying drawings.

Figure 1:
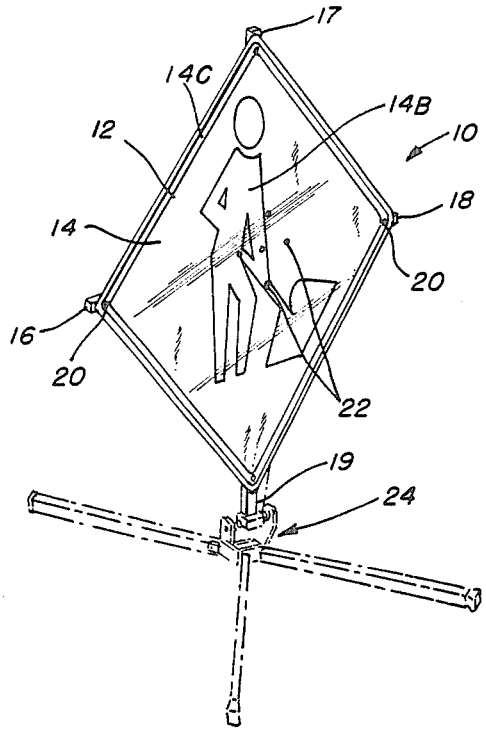
FIG. 1 is a perspective view of a preferred embodiment showing how the sign is mounted on a suitable base.

FIGS. 1 to 5 show the preferred embodiment of the present invention. In FIG. 1, there is shown the portable, collapsible highway sign assembly generally 10 mounted on a base generally 24 shown in phantom lines which base is not part of the present invention. Any suitable base having a telescoping central support member or other means to which the sign assembly can be attached is usable. A base especially suitable for the present invention is disclosed in applicants' co-pending Ser. No. 594,874 for Deflectable Mounting for Upright Mast wherein one arm of the sign is mounted to the mast member and is firmly secured in an upright position by frictionally inserting said arm within said mast a sufficient distance to firmly lock the arm in place and minimize twisting of the extended sign when exposed to the side - winds. Securing means such as hitch pins, bolts or similar locking devices may be used to lock the arm in place within the mast member.

The sign assembly generally 10 includes a flexible sign panel 12, usually rectangular and preferably having a reflective front side surface 14 and a plain back side 14A, constructed of a tough, durable, foldable material resistant to exposure to the elements over long periods of time. The reflective surface frontside 14 is usually a highly visible highway sign color of orange or the like. A preferred panel 12 material is composed of reinforced fabric of a vinyl microprism reflective sheeting 14 permanently adhered to a vinyl-coated polyester fabric substrate backside 14A.

The side panel reflective surface 14 may contain messages or markings 14B and marginal or border markings 14C as required. These messages and markings are prepared in accordance with conventional commercial practice and materials.

Figure 2:
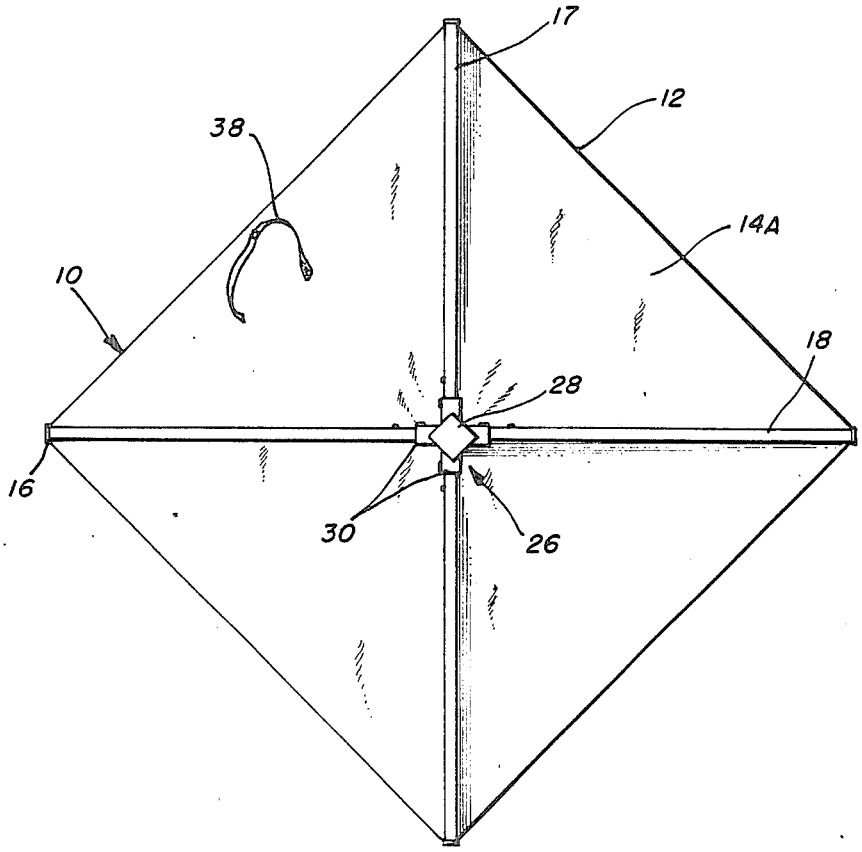
FIG. 2 is a rear view of the sign shown in FIG. 1.

In FIGS. 1 and 2, sign panel 12 is shown securely attached to four pivotally mounted arms indicated at 16, 17, 18, and 19 by fastening means such as large washers and screws or the like shown attached to said arms at 20 at the outer end and 22 at the inner section respectively. Said fastening means attachments 20 and 22 hold the sign panel 12 firmly attached to the arms and in conjunction with the tough, durable, flexible sign panel material 14A and 14B prevent tearing of the sign panel 12 in strong winds and rough handling.

Figure 4:
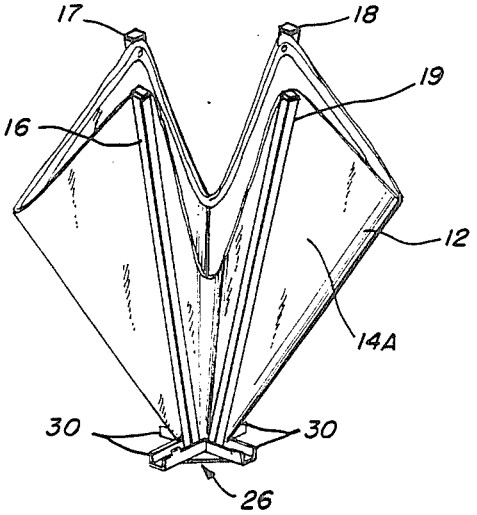
FIG. 4 is a view of the partially-folded sign.
Figure 3:
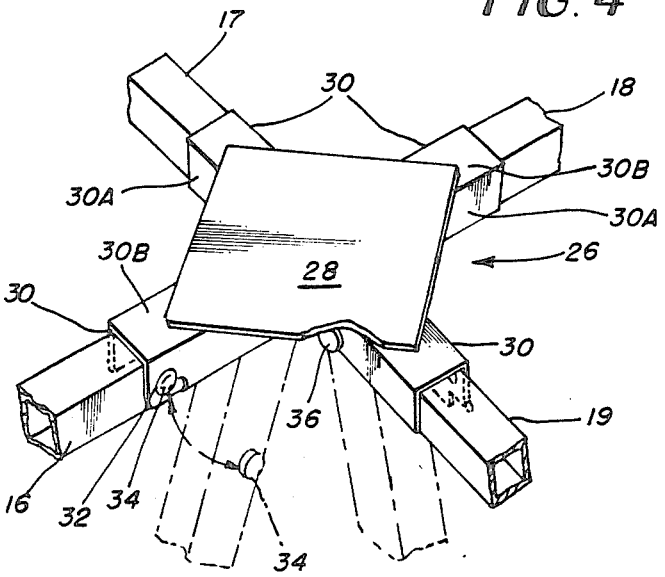
FIG. 3 is a perspective view of the central web.

Referring to FIG. 3, a central web 26 is shown with arms 16, 17, 18, and 19 pivotally attached thereto. The central web 26 is composed of a rigid, flat plate 28, made of sturdy, inflexible, tough material such as metal, plastic or rubber. Firmly secured to the plate 28 are four (4) channel sections 30. The channel sections 30 extend out from the center of the plate 28 and are defined by a pair of sidewalls 30A and a bottomwall 30B. It is seen that each channel 30 contains within, a pivotally attached arm 16–19 when the arms are in the extended position. Arms 16–19 include a releasable securing device 34, such as a spring loaded button, which prtrudes through an aligned hole 32 in each channel 30 to securely lock the arms 16–19 in an extended position as shown in FIG. 2. Pivot means such as pins 36, extend through each respective arm and thereby enable the arms to pivot and move inwardly in one direction only. At the time the sign is being folded in a stored position, each securing device 34 is released, such as by depressing with the finger the spring-loaded button, thereby releasing the arms 16–19 and allowing them to move into the folded position as shown in FIG. 4.

The central web in conjunction with the arms 16–19 provide a mechanism which is a strong and durable support system for the sign panel making it resistant to all types of weather conditions, high winds as well as air currents generated by the movement of vehicles and also rough handling. The sign is especially resistant to twisting when exposed to side winds. In addition, this mechanism provides a sign which can very simply and quickly be assembled or disassembled for storage.

Figure 5:
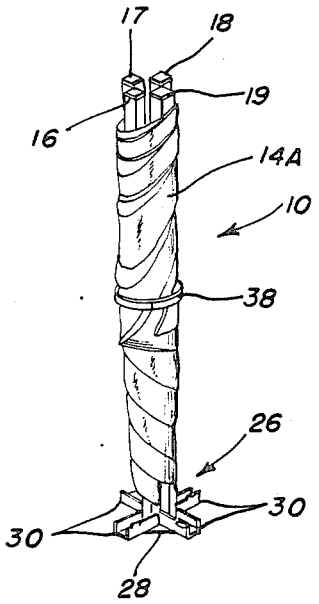
FIG. 5 is a view of the folded sign for compact storage.

Once the sign has been folded to the storage position as shown in FIG. 5, a tieing means, such as a velcro strap 38, is wrapped and fastened around the folded sign. It is to be noted that the panel is divided at the time of storing into four (4) individuals folds, as shown in FIG. 4, and pulled to the outside so as to allow them to be layered over each other in a spiral manner before the strap is secured. This feature results in a compact bundle for storage which takes up very little storage space and fully protects the reflective display surface 14.

FIGS. 1–5 show that the present sign construction is an improvement over. the prior art by providing a strong, durable support system wherein:

(1) the rigid central web system 26 in conjunction with fastening means 20 and 22 and with releasably securing means 34 firmly hold the sign panel in the extended position and prevents the panel from being torn from the arms by reversible winds or by rough handling.

(2) the rigid central web system 26 in conjunction with the releasably securing means 34 and the pivot means 36 provide means for the sign to be quickly assembled and disassembled and for the panel to be folded down in layers before securing for a compact storage bundle.

(3) the sign when attached to an appropriate base will readily withstand wind forces and not be blown over. While it will be understood that the foregoing relates to the preferred embodiments of the present invention, the following claims are intended to encompass all embodiments which fall within the scope of the invention.

We claim:

1. An improved portable collapsible sign comprising:
a flexible panel attached to a frame,
said frame comprising four (4) rigid arms pivotably mounted to a rigid central web,
releasable securing means for locking said arms to said central web in an extended position in the form of a cross and firmly holding said message panel in position,
pivot means connecting each of said arms to said central web to enable each of said arms and said flexible panel to be folded down in only one direction.

2. The sign according to claim 1 whereby said arms and said flexible panel form a compact bundle when folded down and wherein said panel is fastened to the inward side of said arms in said direction of fold.

3. The sign according to claim 2 wherein said rigid central web is composed of four (4) channel sections firmly secured to a rigid plate enabling each of said arms to be pivotally mounted through one each of said channels to said central web.

4. The sign according to claim 3 wherein said fastening means are large washers and screws attached to the outer arms and inner section of the frame.

5. The sign of claim 4 wherein said releasably securing means is a spring loaded button attached to each arm engagable with a hole in the respective channel section.

6. The sign according to claim 5 wherein said pivot means are four (4) shafts one each extending horizontally through each arm and seated in each of said channel sections.

7. The sign according to claim 5 wherein it is mounted to a suitable base.

8. The sign according to claim 6 wherein said base contains a mast central support.

9. The sign according to claim 5 having a tieing means enabling the dismantled folded down sign to be tied into a compact storage bundle.

10. An improved portable collapsible sign comprising:

a flexible panel, a frame comprising four (4) rigid arms attached to a rigid central web, wherein said central web is composed of four (4) channel sections firmly secured to a rigid plate enabling each of said arms to be pivotally mounted through one of said channels of said central web, fastening means attaching said message panel to said arms and said central web, releasably securing means attached to each of said arms and to protrude through a hole in each of said channel sections for locking said arms in an extended position in the form of a cross and firmly holding said message panel in position, pivot means connecting said arms to said central web to enable said arms and, said sign panel to be folded down in a single direction of fold and form a compact bundle whereby the panel is fastened to the inward side of each arm so as to be within the arms when folded and having large area fastening means.

11. The sign according to claim 3, wherein fastening means attach said panel to said frame.

* * * * *